United States Patent [19]

Juliver

[11] Patent Number: 4,756,030

[45] Date of Patent: Jul. 12, 1988

[54] BATHROOM CONTROLLER

[76] Inventor: Steven J. Juliver, 665 Roselawn Ave., Apt. 307, Toronto, Ontario, Canada

[21] Appl. No.: 100,196

[22] Filed: Sep. 23, 1987

[51] Int. Cl.[4] ..... E03C 1/04

[52] U.S. Cl. ..... 4/192; 4/191; 4/661; 4/DIG. 3; 137/334; 137/392; 137/468

[58] Field of Search ..... 4/191, 192, 661, DIG. 3, 4/605, 597; 137/360, 392, 468, 334; 4/559, 546, 553, 615

[56] References Cited

U.S. PATENT DOCUMENTS

| | | | |
|---|---|---|---|
| 2,991,481 | 7/1961 | Book | 4/194 X |
| 4,189,792 | 2/1980 | Vaach | 4/192 |
| 4,429,422 | 2/1984 | Wareham | 4/192 |
| 4,554,688 | 11/1985 | Puccarella | 4/191 |
| 4,563,780 | 1/1986 | Pollack | 4/191 X |
| 4,688,273 | 8/1987 | Lyng | 4/191 X |
| 4,693,415 | 9/1987 | Sturm | 4/192 X |
| 4,694,512 | 9/1987 | Knebel et al. | 4/191 |

*Primary Examiner*—Henry K. Artis
*Attorney, Agent, or Firm*—George A. Rolston

[57] ABSTRACT

A fluid controller for a fluid supply system such as the plumbing supply system for a bathroom comprises hot and cold fluid temperature sensors and flow sensors which are installed in respective ones of the hot and cold fluid supply pipes upstream of the fluid discharge outlet. Hot and cold fluid flow control valves operated by valve motors are also installed in such pipes. The sensors and motors are connected to a microprocessor including a comparator means which is operative to compare values programmed in a memory means with signals received from the sensors so as to generate control signals for the motors so as to obtain a desired fluid temperature and flow rate at the discharge outlet. The controller can be installed in an existing plumbing system without disturbing the existing faucets and manual control valves. Alternatively, the controller can be used in a new installation with or without manual control valves.

13 Claims, 2 Drawing Sheets

BATHROOM CONTROLLER

FIELD OF THE INVENTION

The invention relates to a fluid controller for controlling the temperature and flow rate of a fluid such as water to a plumbing fixture, piping, appliance or other point of use. The invention also relates to a water supply system incorporating such a fluid controller.

BACKGROUND OF THE INVENTION

Various different proposals have heretofore been made for providing automatic control of water temperature and/or flow rate and the like in plumbing systems, such as, for example, at a bathtub faucet. Some of such prior proposals are described in the following U.S. Letters Patent namely U.S. Pat. Nos.: 4,563,780, 2,991,481, 3,74,195, 3,884,258, 4,189,792, 4,429,422.

Many of these earlier proposals are based on the provision of special forms of bathroom faucets and control valves which are intended to replace existing faucets with their manual control valves.

There are, however, some general problems with this approach. In the first place, it involves complex manufacturing operations, as well as precise monitoring and operation of the control valves in use. Furthermore, the systems previously proposed are generally speaking suited for use in only new construction, since otherwise the existing plumbing fixtures must be removed and discarded. Another more fundamental disadvantage is the fact that, once such a new faucet and control have been installed, then the option for simple manual operation of the faucet in the usual way is lost.

The automated bathroom system described in U.S. Pat. No. 4,563,780 is a typical example of the systems heretofore proposed.

In addition, many of the devices previously proposed were of limited application since they were suitable for use only in bathrooms.

In another instance, where, for example, a person wishes to fill a bathtub, it may be desirable or convenient to have the bathtub automatically filled at a predetermined temperature and at a predetermined time.

Another problem encountered with some of the previously proposed systems is that they are dependent on electrical power. Consequently, there is the possibility of a power failure or temporary breakdown in the power supply while a person is using a facility. In this case, most systems will simply shut off immediately, leaving the occupant with the problem of finishing bathing and having to remove soap without any water.

Clearly, it is desirable to have a fluid controller which alleviates these various problems, and in particular which provides a user with the option of using regular existing manual controls, if desired.

It is additionally desirable to provide a system which can be installed at a location more remote from the actual discharge outlet than is possible with the prior art proposals thereby avoiding the need to damage the tiles or other finish surrounding a bathtub.

Accordingly, it is a principal object of the present invention to provide a fluid controller for automatically controlling water temperature and flow through a water flow discharge outlet or faucet and which can be used, for example, in a bathroom installation with the existing plumbing system without disturbing the existing discharge outlet or faucet.

More particularly, it is an object of this invention to provide a fluid controller for automatically controlling water temperature and flow through a water discharge outlet or faucet and which can also be used in a new construction instead of a conventional and separate manually controllable faucet.

It is a further object of this invention to provide a fluid controller which is capable of storing information concerning water temperature, time on and time off, and even total water flow in some cases and which, in one embodiment, may provide for emergency operation of the system for a predetermined length of time after a power failure.

More particularly, it is an object of the invention to provide a fluid controller having the foregoing advantages, and which further includes auxiliary power means operable in the event of a failure of the main power supply, to continue operation of the controller for a predetermined period of time.

Yet another object of the invention to provide a fluid controller having the foregoing advantages and including timer means for controlling the switching on and off of said valve means, and further timer means for controlling the duration of operation.

Other objects of the invention and the advantages presented thereby will become apparent as the description herein proceeds.

SUMMARY OF THE INVENTION

With a view to overcoming all of the various problems and disadvantages noted above, the present invention provides a fluid controller for controlling fluid temperature and flow through a fluid flow discharge outlet supplied with hot and cold fluid from hot and cold fluid sources respectively via respective hot and cold fluid supply pipes and which controller comprises hot fluid flow-controlling valve means adapted to be installed in said hot fluid supply pipe upstream of said fluid flow discharge outlet and having hot fluid motor means operatively associated therewith to operate same and to control the flow of hot fluid therethrough; cold fluid flow-controlling valve means adapted to be installed in said cold fluid supply pipe upstream of said fluid flow discharge outlet and having cold fluid motor means operatively associated therewith to operate same and to control the flow of cold fluid therethrough; hot fluid temperature-sensing means adapted to be attached to said hot fluid supply pipe upstream of said fluid flow discharge outlet sand operative to sense the temperature of hot fluid flowing through said hot fluid supply pipe; cold fluid temperature-sensing means adapted to be attached to said cold fluid supply pipe upstream of said fluid flow discharge outlet and operative to sense the temperature of cold fluid flowing through said cold water fluid supply pipe; hot fluid flow-sensing means adapted to be attached to said hot fluid supply pipe upstream of said fluid flow discharge outlet and operative to sense the rate of flow of hot fluid therethrough; cold fluid flow-sensing means adapted to be attached to said cold fluid supply pipe upstream of said fluid flow discharge outlet and operative to sense the rate of flow of cold fluid therethrough; a signal processor including comparator means connectable to a principal electrical power supply and connected to said hot and cold fluid motor means, to said hot and cold fluid temperature-sensing means and to said hot and cold fluid flow-sensing means, and a memory means operatively associated with said signal processor and adapted to store predetermined parameters concerning desired hot and cold fluid temperatures and flow values, and said comparator means being adapted to process information from said hot and cold fluid temperature-sensing means and said hot and cold fluid flow-sensing means and, in response thereto to calculate the temperature of the fluid at the discharge outlet and to compare said calculated temperature with a desired temperature in said memory means and to generate control signals for said hot and cold fluid motor means thereby to operate said hot and cold fluid flow-controlling valve means as needed to regulate the flow of hot and cold fluid in respective said hot and cold fluid supply pipes to procure the desired temperature at said discharge outlet.

In addition to providing a fluid controller as hereinbefore defined, this invention also embraces a fluid supply system comprising hot and cold fluid sources; a fluid flow discharge outlet; hot and cold fluid supply pipes extending from respective ones of said hot and cold fluid sources to said fluid flow discharge outlet for the supply of hot and cold fluid respectively thereto; hot fluid flow-controlling valve means in said hot fluid supply pipe upstream of said fluid flow discharge outlet and having hot fluid motor means operatively associated therewith to operate same and to control the flow of hot fluid therethrough; cold fluid flow-controlling valve means in said cold fluid supply pipe upstream of said fluid flow discharge outlet and having cold fluid motor means operatively associated therewith to operate same and to control the flow of cold fluid therethrough; hot fluid temperature-sensing means attached to said hot fluid supply pipe upstream of said fluid flow discharge outlet and operative to sense the temperature of hot fluid flowing through said hot fluid supply pipe; cold fluid temperature-sensing means attached to said cold fluid supply pipe upstream of said fluid flow discharge outlet and operative to sense the temperature of cold fluid flowing through said cold fluid supply pipe; hot fluid flow-sensing means attached to said hot fluid supply pipe upstream of said fluid flow discharge outlet and operative to sense the rate of flow of hot fluid therethrough; cold fluid flow-sensing means attached to said cold fluid supply pipe upstream of said fluid flow discharge outlet and operative to sense the rate of flow of cold fluid therethrough; and a signal processor including comparator means, connectable to a principal electrical power supply and connected to said hot and cold fluid motor means, to said hot and cold fluid temperature-sensing means and to said hot and cold fluid flow-sensing means, and said comparator means being adapted to process information from said hot and cold fluid temperature-sensing means and said hot and cold fluid flow-sensing means and, in response thereto, to calculate the temperature of the fluid at said discharge outlet and to compare said calculated temperature with a desired temperature and to generate control signals for said hot and cold fluid motor means thereby to operate said hot and cold fluid flow-controlling valve means as needed to regulate the flow of hot and cold fluid in respective said hot and cold fluid supply pipes to procure the desired temperature at said discharge outlet.

In accordance with a preferred feature of this invention, the memory means provided in a fluid controller is advantageously adapted to store individual predetermined parameters concerning hot and cold fluid temperatures and flow values for individual users whereby, on input to said signal processor of an individual user identification signal, said signal processor is operative automatically to control said hot and cold fluid flow-controlling valve means to supply fluid to said discharge outlet in accordance with said individual predetermined parameters.

Such a fluid controller usefully additionally comprises timer means operatively associated with said signal processor and adapted to control operation of said hot and cold fluid flow-controlling valve means in accordance with a predetermined timed sequence.

Furthermore, such a fluid controller additionally comprises input means for inputting information to said signal processor. Such input means can also include modem means whereby information may be inputted to said signal processor by telephonic communication therewith.

Display means operatively associated with said signal processor are usefully provided for displaying information therefrom.

In accordance with another preferred feature of this invention, a fluid controller additionally comprises an auxiliary electrical power supply means operable automatically to power said signal processor and said hot and cold fluid motor means in the event of a failure of said principal electrical power supply, thereby to permit continued operation of said fluid controller at least for a short time after such failure.

A fluid supply system as provided by this invention may comprise an existing water plumbing system with one or more manually controllable faucets and in which a fluid controller as previously defined has been incorporated.

Alternatively, a fluid controller as provided by this invention may be installed as such in a new plumbing system without any separate manually operable hot and cold water flow control valves.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF SPECIFIC EMBODIMENTS

Figure 1:
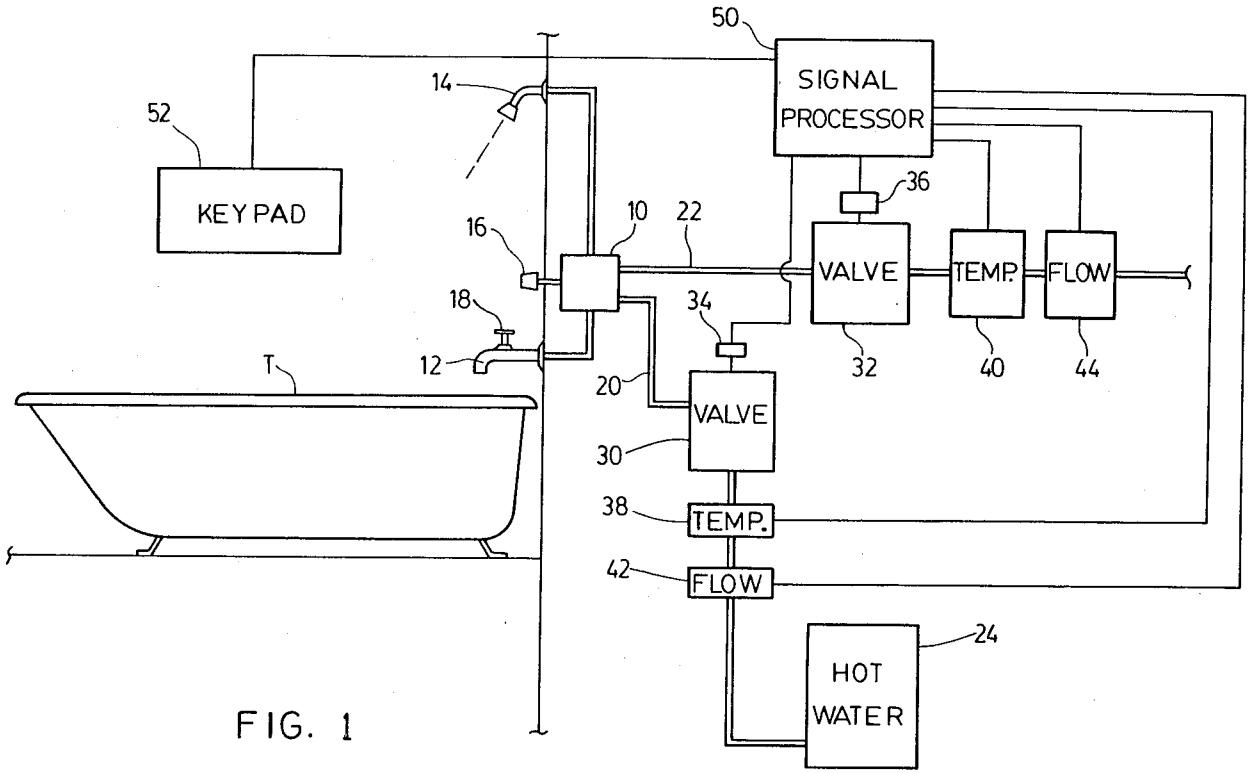
FIG. 1 is a schematic illustration of a bathtub, showing a conventional faucet valve and shower head, and equipped with a fluid controller according to the invention; and, FIG. 2 is a schematic block diagram of the fluid controller of FIG. 1 and also showing certain additional and optional components which can be added in a water supply system in accordance with this invention.

Referring first to FIG. 1, it will be seen that this preferred embodiment of a fluid controller according to the invention is illustrated in connection with a plumbing facility, in this case, a conventional bathtub T, provided with a conventional manually controlled faucet valve 10. Faucet valve 10 is connected so as to supply either the tub supply outlet 12 or the shower outlet or head 14. Typically, the valve 10 and the pipes connecting to the outlets 12 and 14, will be built into the wall. Typically the wall will then have been tiled, so that access to the faucet or the pipes supplying the two outlets is possible only at very considerable expense and inconvenience.

As will become apparent from the following description, however, by the use of the invention, the controller can be installed and connected generally speaking without tampering with the wall or tub surround and with less disruption than would be necessary if the entire valve 10 and outlets 12 and 14 were to be replaced.

Typically the faucet valve 10 will have either one or two manual control knobs 16 for controlling the flow of hot and cold water. It will of course be appreciated that the hot and cold water flow becomes mixed usually within the valve 10 itself, depending upon the particular design, and then flows as a mixture to either of the outlets 12 and 14.

By operation of one or two control knobs 16, the temperature and flow rate of the water mixture can be controlled in an entirely conventional manner.

Again in a typical installation, the tub outlet 12 will normally have a manual diverter knob 18, by means of which flow through outlet 12 can be stopped, thereby causing the flow to go upwardly to shower head 14.

As noted above, all of this is entirely conventional and is described here only to illustrate that a fluid controller according to the present invention can be incorporated in a plumbing system without in any way altering or tampering with the existing faucet valve and water outlets of the facility.

It will of course also be appreciated that the description and illustration of a conventional bathroom facility is merely by way of illustration. The fluid controller itself may have many other applications other than in a conventional existing bathroom. For the purpose of this explanation, therefore, any reference to faucet, tub outlet, shower head or the like is to be understood as merely being illustrative of the application of the fluid controller. Such a tub outlet or shower head may in fact be any plumbing facility from which or through which water may flow, and at which it is desired to control water temperature and flow rate. Such a facility may include other fixtures connected to other equipment such as dishwashers, washing machines, and the like, and in domestic, commercial and institutional situations.

Referring now in greater detail to the description of the present invention, it will be noted that the faucet valve 10 is supplied with hot water via hot water pipe 20 and with cold water via cold water pipe 22. The hot water source will typically be a hot water tank 24. The cold water source will typically be the incoming household water main, which is represented simply by a continuation of the pipe 22.

Pipes 20 and 22 will typically be located inside walls or floors and, in most cases, access can be obtained to those pipes simply by removing a portion of the dry wall or other wall panelling, or by removing a floor board. It will be understood that such access can often be more readily obtained at a location somewhat remote from the bathroom thereby avoiding the need for disturbing the bathroom wall tiles or tub surround. In some cases, access may conveniently be obtained to such pipes at locations, for example, in basements, where such pipes are exposed so avoiding the need for any wall removal or the like.

In accordance with this invention, the pipes 20 and 22 are provided with hot and cold water control valves 30 and 32 respectively. Valves 30 and 32 are operated by respective electrical drive motors 34 and 36, which are powered and controlled in a manner yet to be described.

Pipes 30 and 32 are further provided with hot and cold water temperature sensors 38 and 40. Sensors 38 and 40 are operable to continuously monitor the temperature of water flowing in their respective pipes and to deliver temperature signals in a manner described below.

In accordance with this invention, pipes 20 and 22 are further provided with water flow sensors 42 and 44. Sensors 42 and 44 continuously monitor the rates of flow of water through the pipes 20 and 22 respectively and deliver flow signals in a manner to be described below.

In order to process the information from the sensors 38, 40, 42 and 44 and to deliver control signals to motors 34 and 36, a signal processor 50 is provided. Processor 50 is connected via suitable electrical means to the motors 34 and 36 and to the sensors 38, 40, 42 and 44.

The processor 50 is usefully connected to a visual display and input key pad unit 52 which can be installed at any appropriate location, either adjacent to or removed from the plumbing facility.

Figure 2:
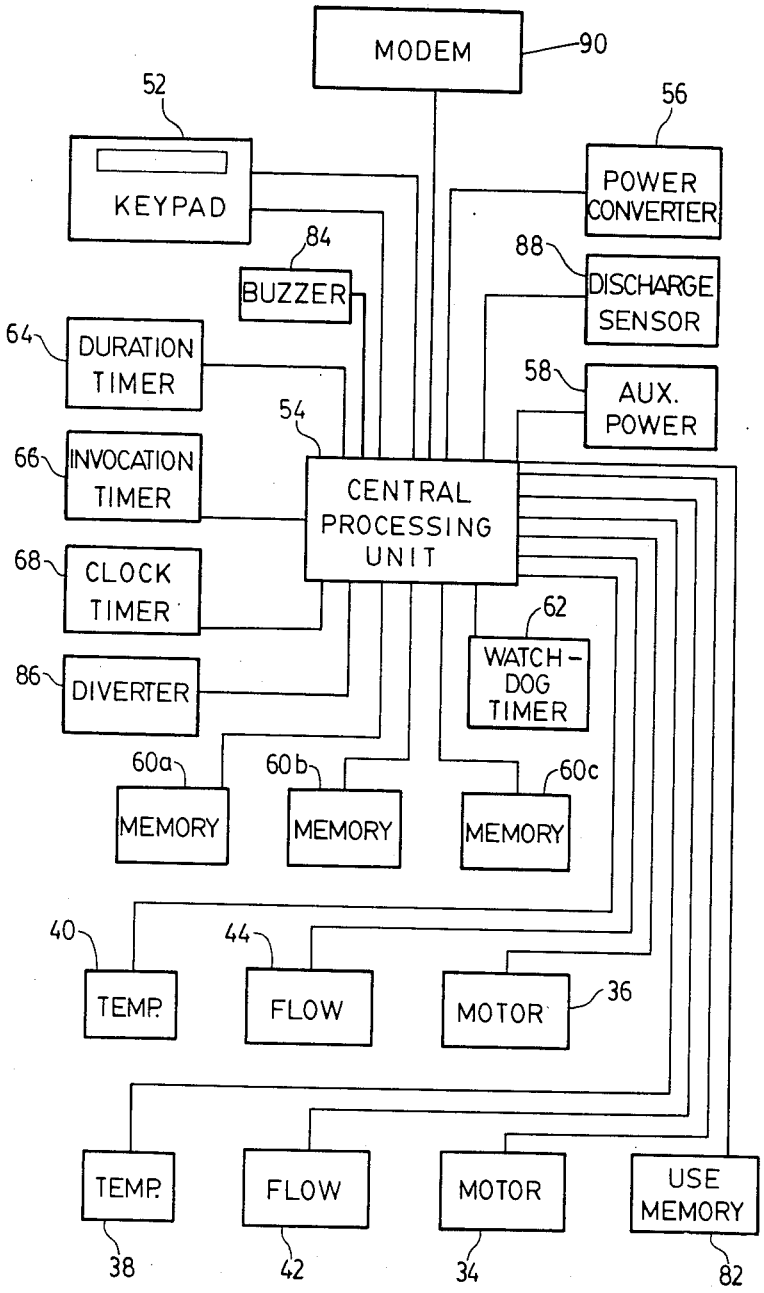

Referring now to FIG. 2, the processor 50 will be seen to comprise a central processing unit (CPU) 54 which will typically be a micro-processor. The CPU 54 is supplied with power at an appropriate voltage by a principal power supply or converter 56, which in turn is typically supplied by the mains electrical supply 57.

In accordance with a particularly useful and preferred feature of this invention, an auxiliary battery power supply 58 is also connected to the CPU 54. Auxiliary power supply 58 is normally off and is adapted to receive a signal from CPU 54 if and when the power supply from the converter 56 fails for any reason.

CPU 54 is connected to a series of separate memories indicated as 60*a*, 60*b*, 60*c*, etc., for storing information as will be explained in greater detail as the description herein proceeds.

CPU 54 is further connected to watch dog timer 62, a duration timer 64, an invocation timer 66, and a clock timer 68. The watch dog timer 62 serves to monitor the operation of the system. The clock timer 68 functions simply to provide a signal regarding real time. The real time signal may also be displayed on the key pad display 52 for added convenience.

The duration timer 64 serves to time the duration of water flow.

The invocation timer 66 functions to provide a time signal to start water flow.

Cold water flow is controlled in response to temperature sensor 40 and flow sensor 44 by flow valve motor 36.

Hot water flow is similarly controlled in response to temperature sensor 38 and flow sensor 42 by flow valve motor 34.

In operation, the faucet valve 10 will normally be left fully open with both hot and cold water flow control knobs 16 also set for maximum flow.

It will be understood that the tub shut-off or diverter 18 for the tub outlet 12 will normally be in the open position. This will mean that any water flow that takes place without the shut-off 18 being operated, will flow through outlet 12 into the tub.

This is in fact desirable from the viewpoint of the operation of the invention. Normally, where a person is taking a shower, it will not be required for the shower to be switched on at a predetermined time. In most cases a person taking a shower will simply want the shower to operate as soon as he switches on the control.

On the other hand, a person may well wish to program the system so as to fill a bath tub at a predetermined temperature commencing at a predetermined time in the future.

The operation of the shower will make use of the fact that the tub outlet 12 is normally open and can only be closed by manual operation of the shut-off 18.

When starting up operation for the first time, a person will normally key in using the key pad 52 an individual identification code and values for the desired temperature and water flow rate. This information will then be stored in an appropriate one of the memories 60*a*, 60*b* or 60*c*.

The user would then, through key pad 52, provide an immediate "on" signal to signal processor 50, which will, in turn, deliver appropriate signals to motors 34 and 36 to set them to appropriate positions for the desired temperatures and flow rates.

Water will then flow through the pipes 20 and 22 to the faucet valve 10 and initially out through the tub outlet 12. The individual will then operate the diverter 18 causing water then to flow to the shower outlet 14. At this stage, the hot water may be somewhat under temperature and will only gradually come up to full temperature. Conversely, the cold water may be slightly above the normal cold water temperature and may gradually drop to the temperature of the incoming main.

Differences in temperature will be sensed by sensors 38 and 40, sending appropriate signals to signal processor 50 which will, in turn, continuously signal motors 34 and 36 to adopt different positions. This will continuously vary the flow rate of hot or cold water, or both, as needed, to maintain a pre-set temperature.

As the position of the valves 30 and 32 is altered, the relative flow between hot and cold water is altered and this will be sensed via flow sensors 42 and 44 which will in turn provide information to signal processor 50.

The processor 50 includes comparator means adapted to compare the two temperatures and the two flow rates and, in response thereto, to calculate the temperature of the water at the discharge outlet and then to compare said calculated discharge temperature with a desired discharge temperature, the value of which is programmed into a predetermined one of the memories 60*a*, 60*b* and 60*c*. The processor 50 also generates control signals operative to continuously adjust the motors 34 and 36 so as to regulate the flow of hot and cold water in the hot and cold water supply pipes to procure the desired discharge temperature and a desired flow rate at the showerhead 14, or other discharge outlet.

In the case of filling the tub with water, where, for example, it may be desired to cause the tub to be filled at a predetermined time, then the individual will also key in the appropriate time duration and start up time information. In this case, when the appointed time is reached, as sensed by clock timer 68, the time invocation control 66 will issue a start-up signal, and information from the appropriate memory 60*a*, 60*b* or 60*c* will be supplied to the CPU 54 as to temperature and flow rate. After a predetermined elapsed time, duration timer 64 will then issue a shut off signal, causing the two valves 30 and 32 to be shut off.

In the event that, for any reason, it is desired, such as if such fluid controllers are used in institutions, hotels or the like, signal processor 50 may optionally be connected to a memory 82 for collecting information concerning flow rates and times. Such information may also be supplied directly to a central location in a hotel where information for all flow volumes in all rooms may be continuosly monitored and recorded, for billing or other purposes.

In the event of any interruption of the main power supply, the signal processor 50 will instruct the auxilliary power supply 58 to supply power for a predetermined length of time, allowing for continued operation of the device, for example, for a predetermined period of time. At the same time, an audible warning device such as the buzzer 84 may give an audible warning that the water flow will shortly shut off.

In addition, the key pad 52 can incorporate an override control whereby the signal processor 50 be simply rendered inoperative, leaving both valves 30 and 32 wide open. This may be desirable if, for example, a member of the household wishes to use the manual faucet valve 10 without using the fluid controller according to the invention.

While the invention has hereinbefore been particularly described with reference to its installation in an existing plumbing facility, it should be understood that it can also be used in a new plumbing installation. In such a situation, the conventional faucet valve 10 and control knobs 16 can be dispensed with completely, if desired. In such a case, operation of the system would be controlled solely by means of the CPU 54 under the control of the key pad 52 and the other components of the processor 50 as already described. Additionally, if desired, the tub shut-off control 18 in such a new installation could be replaced by a solenoid operated diverter valve indicated schematically at 86 under the control of the processor 50. In such a new installation, an additional discharge water temperature sensor 88 can be provided at the actual discharge outlet.

Yet another possibility within the scope of this invention is to provide an auxiliary input in the form of a modem 90 whereby programming and/or operating signals can be fed to CPU 54 from a telephone line (not shown). Other remote input systems are also possible.

The foregoing is a description of preferred embodiments of the invention which is given here by way of example only. The invention is not to be taken as limited to any of the specific features as described, but comprehends all such variations thereof as come within the scope of the appended claims.

What is claimed is:

1. A fluid controller for controlling fluid temperature and flow through a fluid flow discharge outlet supplied with hot and cold fluid from hot and cold fluid sources respectively via respective hot and cold fluid supply pipes and which controller comprises:

hot fluid flow-controlling valve means adapted to be installed in said hot fluid supply pipe upstream of said fluid flow discharge outlet and having hot fluid motor means operatively associated therewith to operate same and to control the flow of hot fluid therethrough;

cold fluid flow-controlling valve means adapted to be installed in said cold fluid supply pipe upstream of said fluid flow discharge outlet and having cold fluid motor means operatively associated therewith to operate same and to control the flow of cold fluid therethrough;

hot fluid temperature-sensing means adapted to be attached to said hot fluid supply pipe upstream of said fluid flow discharge outlet and operative to sense the temperature of hot fluid flowing through said hot fluid supply pipe;

cold fluid temperature-sensing means adapted to be attached to said cold fluid supply pipe upstream of said fluid flow discharge outlet and operative to sense the temperature of cold fluid flowing through said cold fluid supply pipe;

hot fluid flow-sensing means adapted to be attached to said hot fluid supply pipe upstream of said fluid flow discharge outlet and operative to sense the rate of flow of hot fluid therethrough;

cold fluid flow-sensing means adapted to be attached to said cold fluid supply pipe upstream of said fluid flow discharge outlet and operative to sense the rate of flow of cold fluid therethrough;

a signal processor including comparator means connectable to a principal electrical power supply and connected to said hot and cold fluid motor means, to said hot and cold fluid temperature-sensing means and to said hot and cold fluid flow-sensing means, and a memory means operatively associated with said signal processor and adapted to store predetermined parameters concerning desired hot and cold fluid temperatures and flow values, and said comparator means being adapted to process information from said hot and cold fluid temperature-sensing means and said hot and cold fluid flow-sensing means and, in response thereto to calculate the temperature of the fluid at the discharge outlet and to compare said calculated temperature with a desired temperature in said memory means and to generate control signals for said hot and cold fluid motor means thereby to operate said hot and cold fluid flow-controlling valve means as needed to regulate the flow of hot and cold fluid in respective said hot and cold fluid supply pipes to procure the desired temperature at said discharge outlet.

2. A fluid controller as claimed in claim 1 and in which said memory means is adapted to store individual predetermined parameters concerning hot and cold fluid temperatures and flow values for individual users whereby, on input to said signal processor of an individual user identification signal, said signal processor is operative automatically to control said hot and cold fluid flow-controlling valve means to supply fluid to said discharge outlet in accordance with said individual predetermined parameters.

3. A fluid controller as claimed in claim 2 and which additionally comprises timer means operatively associated with said signal processor and adapted to control operation of said hot and cold fluid flow-controlling valve means in accordance with a predetermined timed sequence.

4. A fluid controller as claimed in claim 2 and which additionally comprises input means for inputting information to said signal processor.

5. A fluid controller as claimed in claim 4 and which additionally comprises modem means whereby information may be inputted to said signal processor by telephonic communication.

6. A fluid controller as claimed in claim 4 and which additionally comprises display means operatively associated with said signal processor for displaying information therefrom.

7. A fluid controller as claimed in claim 2 and which additionally comprises an auxiliary electrical power supply means operable automatically to power said signal processor and said hot and cold fluid motor means in the event of a failure of said principal electrical power supply, thereby to permit continued operaation of said fluid controller at least for a limited time after such failure.

8. A fluid controller as claimed in claim 1 for controlling water temperature and flow through a water flow discharge outlet supplied with hot and cold water from hot and cold water sources respectively via respective hot and cold water supply pipes, in which said hot fluid flow-controlling valve means is a hot water flow-controlling valve means adapted to be installed in said hot water supply pipe upstream of said water flow discharge outlet, in which said cold fluid flow-controlling valve means is a cold water flow-controlling valve means adapted to be installed in said cold water supply pipe upstream of said water flow discharge outlet, in which said hot fluid temperature-sensing means is a hot water temperature-sensing means adapted to be attached to said hot water supply pipe upstream of said water flow discharge outlet, in which said cold fluid temperature-sensing means is a cold water temperature-sensing means adapted to be attached to said cold water supply pipe upstream of said water flow discharge outlet, in which said hot fluid flow-sensing means is a hot water flow-sensing means adapted to be attached to said hot water supply pipe upstream of said water flow discharge outlet, and in which said cold fluid flow-sensing means is a cold water flow-sensing means adapted to be attached to said cold water supply pipe upstream of said water flow discharge outlet.

9. A fluid supply system comprising:

hot and cold fluid sources;

a fluid flow discharge outlet;

hot and cold fluid supply pipes extending from respective ones of said hot and cold fluid sources to said fluid flow discharge outlet for the supply of hot and cold fluid respectively thereto;

hot fluid flow-controlling valve means in said hot fluid supply pipe upstream of said fluid flow discharge outlet and having hot fluid motor means operatively associated therewith to operate same and to control the flow of hot fluid therethrough;

cold fluid flow-controlling valve means in said cold fluid supply pipe upstream of said fluid flow discharge outlet and having cold fluid motor means operatively associated therewith to operate same and to control the flow of cold fluid therethrough;

hot fluid temperature-sensing means attached to said hot fluid supply pipe upstream of said fluid flow discharge outlet and operative to sense the temperature of hot fluid flowing through said hot fluid supply pipe;

cold fluid temperature-sensing means attached to said cold fluid supply pipe upstream of said fluid flow discharge outlet and operative to sense the temperature of cold fluid flowing through said cold fluid supply pipe;

hot fluid flow-sensing means attached to said hot fluid supply pipe upstream of said fluid flow discharge outlet and operative to sense the rate of flow of hot fluid therethrough;

cold fluid flow-sensing means attached to said cold fluid supply pipe upstream of said fluid flow discharge outlet and operative to sense the rate of flow of cold fluid therethrough; and a signal processor including comparator means, connectable to a principal electrical power supply and connected to said hot and cold fluid motor means, to said hot and cold fluid temperature-sensing means and to said hot and cold fluid flow-sensing means, and said comparator means being adapted to process information from said hot and cold fluid temperature-sensing means and said hot and cold fluid flow-sensing means and, in response thereto, to calculate the temperature of the fluid at said discharge outlet and to compare said calculated temperature with a desired temperature and to generate control signals for said hot and cold fluid motor means thereby to operate said hot and cold fluid flow-controlling valve means as needed to regulate the flow of hot and cold fluid in respective said hot and cold fluid supply pipes to procure the desired temperature at said discharge outlet.

10. A fluid supply system as claimed in claim 9 and in which said hot and cold fluid sources are hot and cold water sources, in which said fluid flow discharge outlet is a water flow discharge outlet, in which said hot and cold fluid supply pipes are hot and cold water supply pipes, in which said hot fluid flow-controlling valve means is a hot water flow-controlling valve means in said hot water supply pipe upstream of said water flow discharge outlet, in which said cold fluid flow-controlling valve means is a cold water flow-controlling valve means in said cold water supply pipe upstream of said water flow discharge outlet, in which said hot fluid temperature-sensing means is a hot water temperature-sensing means attached to said hot water supply pipe upstream of said water flow discharge outlet, in which said cold fluid temperature-sensing means is a cold water temperature-sensing means attached to said cold water supply pipe upstream of said water flow discharge outlet, in which said hot fluid flow-sensing means is a hot water flow-sensing means attached to said hot water supply pipe upstream of said water flow discharge outlet, and in which said cold fluid flow-sensing means is a cold water flow-sensing means attached to said cold water supply pipe upstream of said water flow discharge outlet.

11. A water supply system as claimed in claim 10 and which additionally comprises manually operable hot and cold water flow control valves disposed between respective ones of said hot and cold water flow-controlling valves means and said water flow discharge outlet.

12. A water supply system as claimed in claim 10 and which comprises two said water flow discharge outlets connected to said hot and cold water supply pipes and diverter valve means for selectively permitting the flow of water from said hot and cold water supply pipes to a desired one of said water flow discharge outlets and simultaneously preventing the flow of water to the other one of said water flow discharge outlets.

13. A water supply system as claimed in claim 10, which additionally comprises a water discharge temperature-sensing means at said water discharge outlet for sensing the temperature of water discharged therefrom and adapted to provide a signal to said signal processor indicative of said water discharge temperature and in which said signal processor is adapted to operate said hot and cold water flow-controlling valves to maintain said water discharge temperature within a predetermined range of values.

* * * * *